US011185202B2

(12) United States Patent
Fogarty et al.

(10) Patent No.: US 11,185,202 B2
(45) Date of Patent: Nov. 30, 2021

(54) UPRIGHT VACUUM CLEANER HAVING MICROSWITCH AND FILTER ASSEMBLY

(71) Applicant: Emerson Electric Co., St. Louis, MO (US)

(72) Inventors: Thomas E. Fogarty, Alton, IL (US); John L Theising, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 314 days.

(21) Appl. No.: 16/529,208

(22) Filed: Aug. 1, 2019

(65) Prior Publication Data

US 2019/0350423 A1 Nov. 21, 2019

Related U.S. Application Data

(62) Division of application No. 15/620,278, filed on Jun. 12, 2017, now Pat. No. 10,660,497.

(51) Int. Cl.

| | |
|---|---|
| ***A47L 9/28*** | (2006.01) |
| ***A47L 5/30*** | (2006.01) |
| ***A47L 9/04*** | (2006.01) |
| ***A47L 9/14*** | (2006.01) |

(52) U.S. Cl.

CPC ..... *A47L 9/2805* (2013.01); *A47L 5/30* (2013.01); *A47L 9/0411* (2013.01); *A47L 9/0477* (2013.01); *A47L 9/1436* (2013.01); *A47L 9/1472* (2013.01); *A47L 9/28* (2013.01); *A47L 9/2842* (2013.01); *A47L 9/2878* (2013.01); *A47L 9/2884* (2013.01); *A47L 9/2889* (2013.01)

(58) Field of Classification Search

CPC ..... A47L 9/2805; A47L 5/30; A47L 9/0411; A47L 9/0477; A47L 9/1436; A47L 9/1472; A47L 9/28; A47L 9/2842; A47L 9/2878; A47L 9/2884; A47L 9/2889

See application file for complete search history.

(56) References Cited

U.S. PATENT DOCUMENTS

| | | | |
|---|---|---|---|
| 4,001,912 | A | 1/1977 | Eriksson |
| 4,835,409 | A | 5/1989 | Bhagwat et al. |
| 5,102,435 | A | 4/1992 | Rau et al. |
| 5,551,119 | A | 9/1996 | Worwag |
| 5,907,886 | A | 6/1999 | Buscher |
| 6,073,302 | A | 6/2000 | Buscher |
| 8,032,984 | B2 | 10/2011 | Rowntree et al. |
| 2007/0006417 | A1 | 1/2007 | Richardson |
| 2013/0232718 | A1 | 9/2013 | Baek et al. |
| 2014/0245564 | A1 | 9/2014 | Conrad |
| 2017/0042400 | A1 | 2/2017 | Lee et al. |

FOREIGN PATENT DOCUMENTS

| | | | |
|---|---|---|---|
| CN | 1654000 | A | 8/2005 |
| EP | 0895744 | B1 | 8/2003 |
| EP | 2598008 | B1 | 3/2015 |
| JP | 2013146295 | A | 8/2013 |
| KR | 100751788 | B1 | 8/2007 |
| WO | 2007128714 | A1 | 11/2007 |
| WO | 2012013483 | A2 | 2/2012 |

*Primary Examiner* — Andrew A Horton

(74) *Attorney, Agent, or Firm* — Armstrong Teasdale LLP

(57) ABSTRACT

Upright vacuum cleaners that include a switch that detects whether a removable filter assembly has been connected to the vacuum cleaner are disclosed. In some embodiments, the upright vacuum cleaner includes a capacitor for protecting the switch from voltage transients.

17 Claims, 15 Drawing Sheets

UPRIGHT VACUUM CLEANER HAVING MICROSWITCH AND FILTER ASSEMBLY

CROSS-REFERENCE TO RELATED APPLICATIONS

This application is a division of U.S. patent application Ser. No. 15/620,278, filed on Jun. 12, 2017, the disclosure of which is hereby incorporated by reference in its entirety.

FIELD

The field relates to upright vacuum cleaners and, in particular, upright vacuum cleaners that include a switch that detects whether a removable filter has been attached to the vacuum cleaner. In some embodiments, the upright vacuum cleaner includes a capacitor for protecting the switch from voltage transients.

BACKGROUND

Upright vacuum cleaners may include a removable filter assembly for removing debris entrained in an air stream that flows through the vacuum cleaner. A need exists for filter mounts for connecting such removable filter assemblies that are configured with a switch to prevent the upright vacuum cleaner from being powered when the filter assembly is not attached or connected to the vacuum cleaner. A need also exists for devices to protect the switch from fluctuations in voltage such as when the upright vacuum cleaner is powered by a battery.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to an upright vacuum cleaner. The upright vacuum cleaner includes a cleaning head for removing debris from a floor and into the vacuum cleaner. The vacuum cleaner includes a removable filter assembly to filter and collect debris from an airstream and a blower for entraining debris into the airstream and into the filter assembly. The vacuum cleaner includes a motor assembly for powering the blower. A switch is operatively connected to the blower to selectively enable operation of the blower when the removable filter assembly is connected to the upright vacuum cleaner in fluid communication with the blower. A capacitor is operatively connected to the motor assembly to protect the switch from voltage transients.

Another aspect of the present disclosure is directed to an upright vacuum cleaner. The upright vacuum cleaner includes a blower for entraining debris into an airstream and into a removable filter assembly. The vacuum cleaner includes a filter mount for connecting the removable filter assembly. The filter mount includes a body and a filter mount cover plate. The filter mount cover plate is adjustable between an open position and a closed position in which the filter mount cover plate is sealed to the body. The filter mount cover plate is attachable to the removable filter assembly. The vacuum cleaner includes a microswitch connected to the blower to selectively enable operation of the blower when the filter assembly is connected to the filter mount cover plate and the filter mount cover plate is in the closed position.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
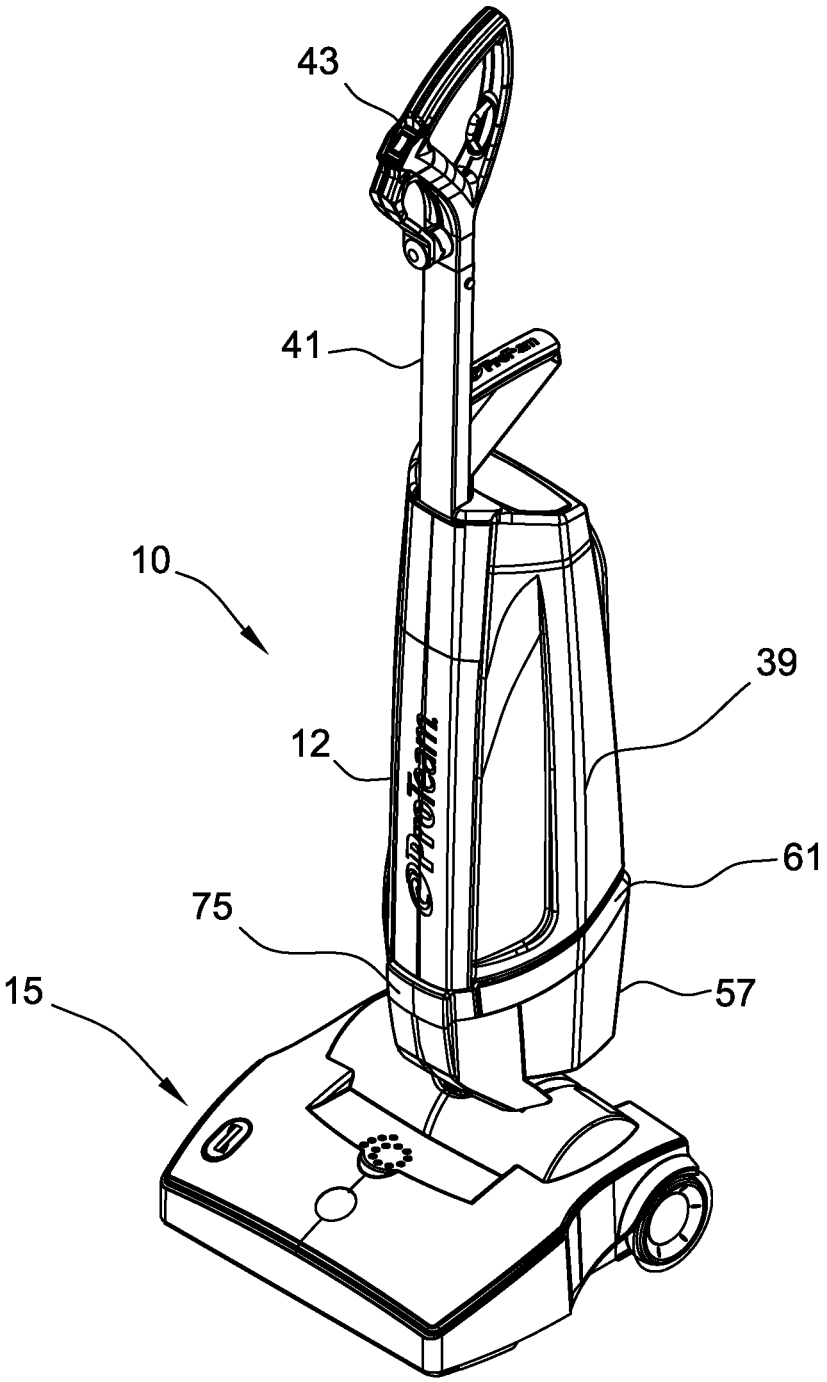
FIG. 1 is a perspective view of an upright vacuum cleaner.
Figure 2:
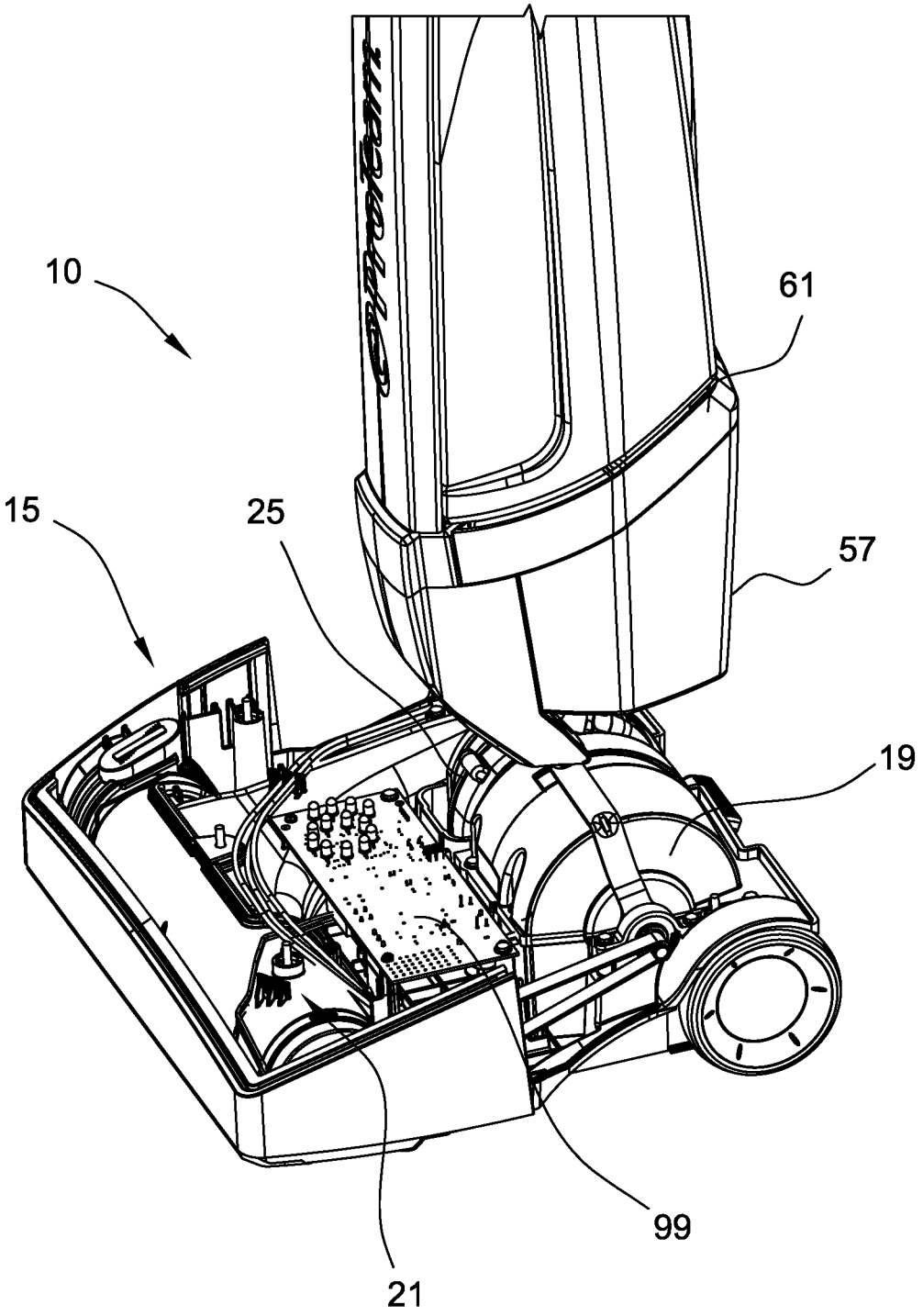
FIG. 2 is a detailed perspective view of the cleaning head of the vacuum cleaner.
Figure 3:
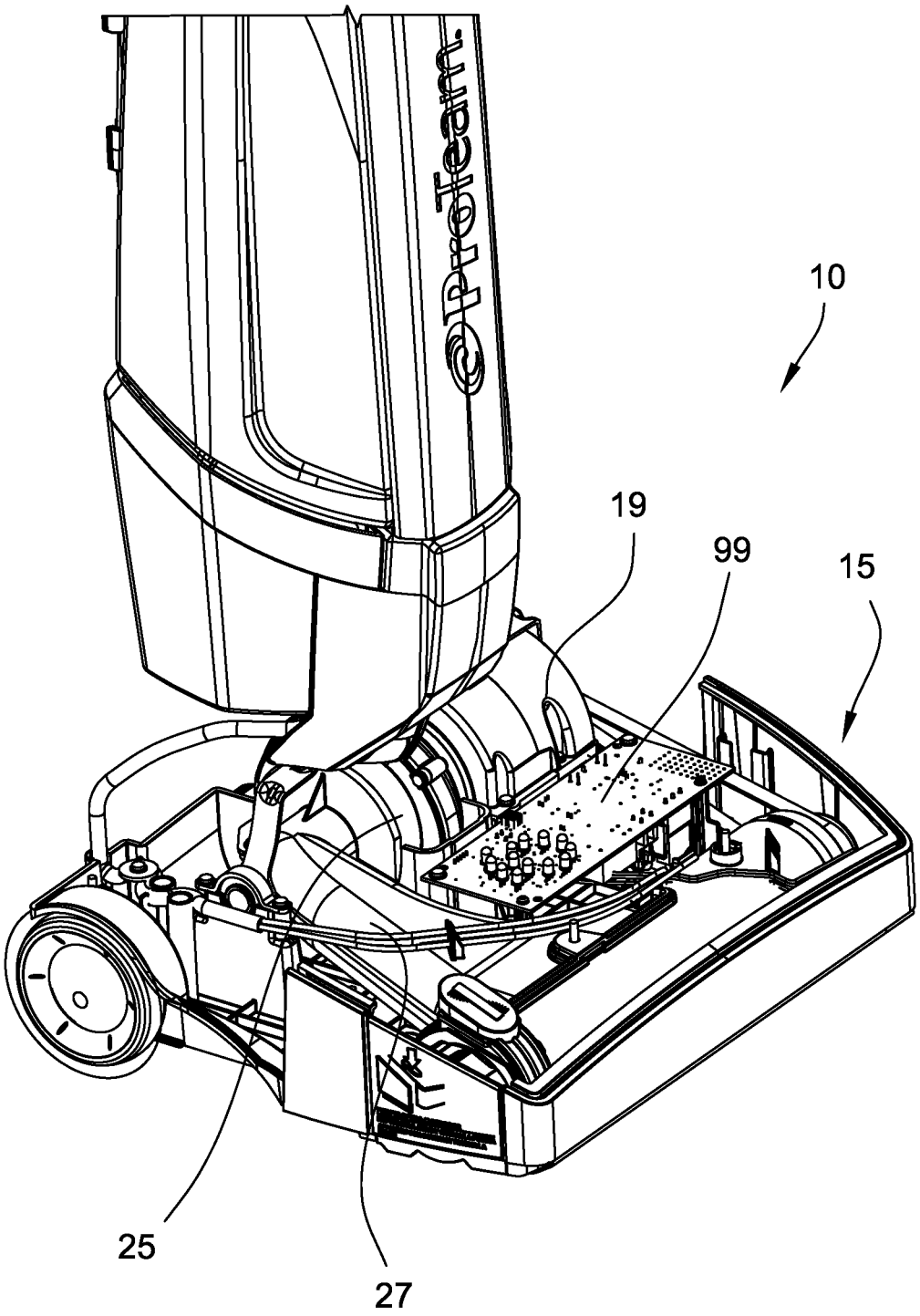
FIG. 3 is another detailed perspective view of the cleaning head.

FIG. 1 is a perspective view of an example vacuum cleaning system 10. The vacuum cleaning system 10 includes an upright vacuum cleaner 12 and battery 57. The vacuum cleaner 12 includes a cleaning head 15 for removing debris from a floor and into the vacuum cleaner 12. The cleaning head 15 includes a motor assembly 19 (FIG. 2) having a motor that powers a brush unit 21. The brush unit 21 includes one or more brushes (not shown) that rotate and contact the floor to agitate debris to promote entrainment of the debris into an airflow pulled within the vacuum cleaner. A blower or fan 25 pulls air and debris from the brush unit 21, through a blower housing 27 (FIG. 3) and into the blower 25. The blower 25 pushes the air and debris into a debris tube 31 (FIG. 4) that extends upward from the cleaning head 15. The debris tube 31 is pivotally attached to the cleaning head 15.

Figure 4:
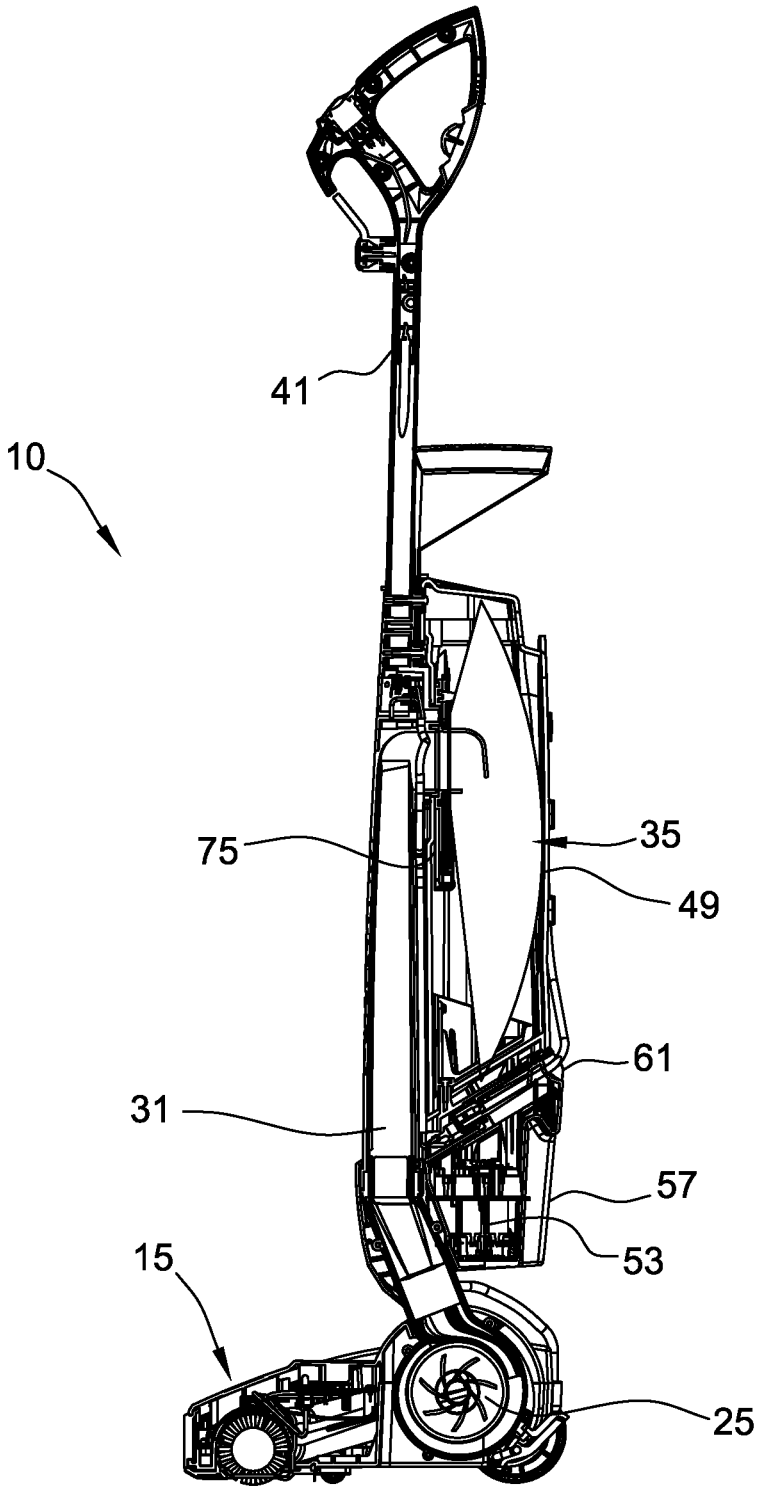
FIG. 4 is a cross-section side view of the vacuum cleaner.
Figure 5:
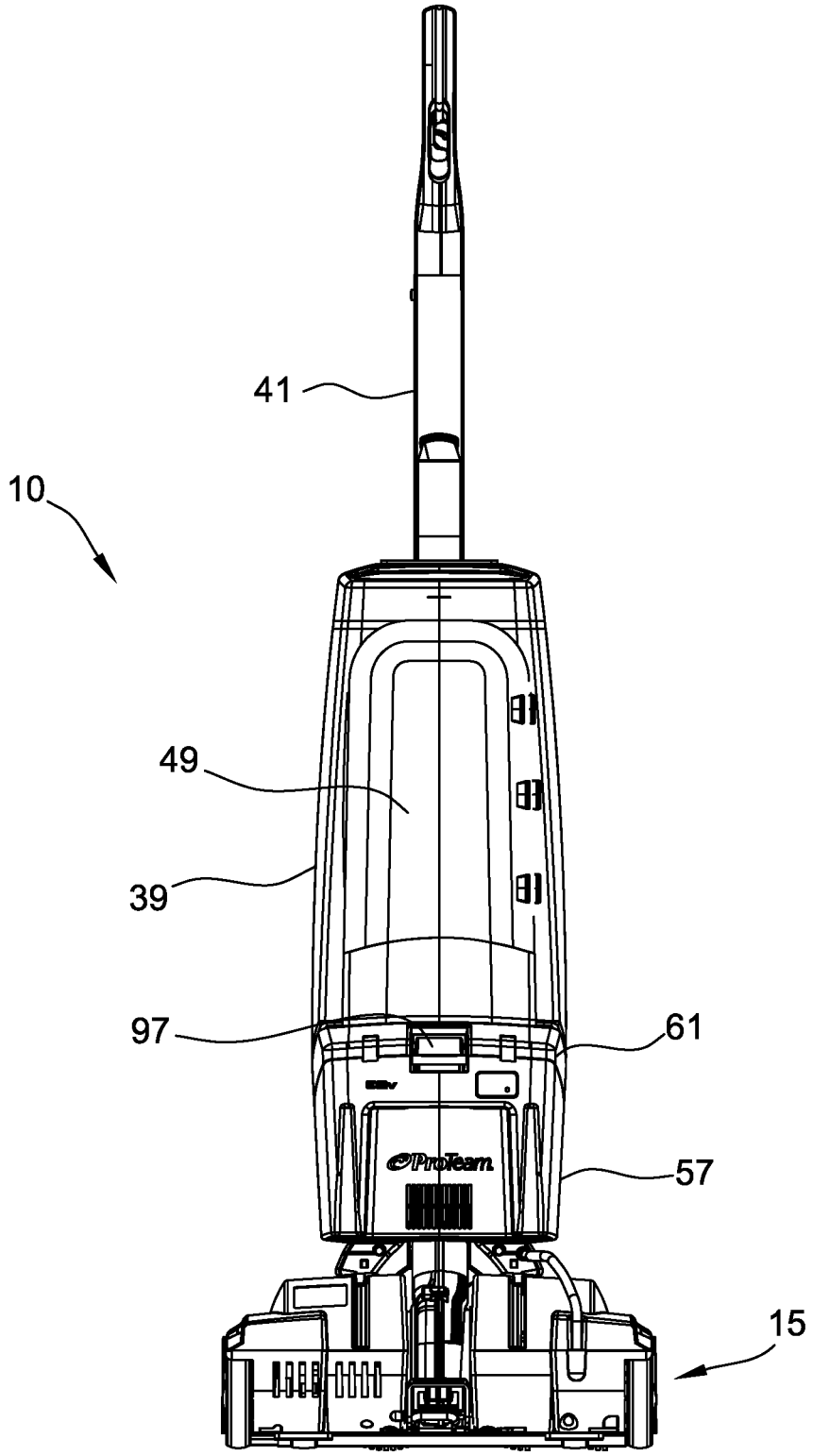
FIG. 5 is a rear view of the vacuum cleaner.

Referring now to FIG. 4, the debris tube 31 is fluidly connected to the blower 25 and a removable filter assembly 35. Air and debris travel up the debris tube 31 and are discharged into the filter assembly 35. The filter assembly 35 filters and collects debris from the airstream. The filter assembly 35 is disposed within a filter housing 39 (FIG. 5). The filter housing 39 may be rigid (e.g., plastic) or flexible (e.g., flexible thermoformed foam housing with a fabric exterior) or a combination of rigid and flexible components.

The filter housing 39 includes an access door 49 (FIG. 5) to allow access to the filter assembly 35 (e.g., to insert or remove the filter assembly 35). The filter assembly 35 may be a bag filter or cartridge filter. The filter assembly 35 selectively allows air to pass through the filter and retain debris within the filter assembly.

A handle assembly 41 is attached to the debris tube 31 (FIG. 4). The handle assembly 41 includes a power switch 43 (FIG. 1) that selectively causes the vacuum cleaner 12 to be powered.

Figure 6:
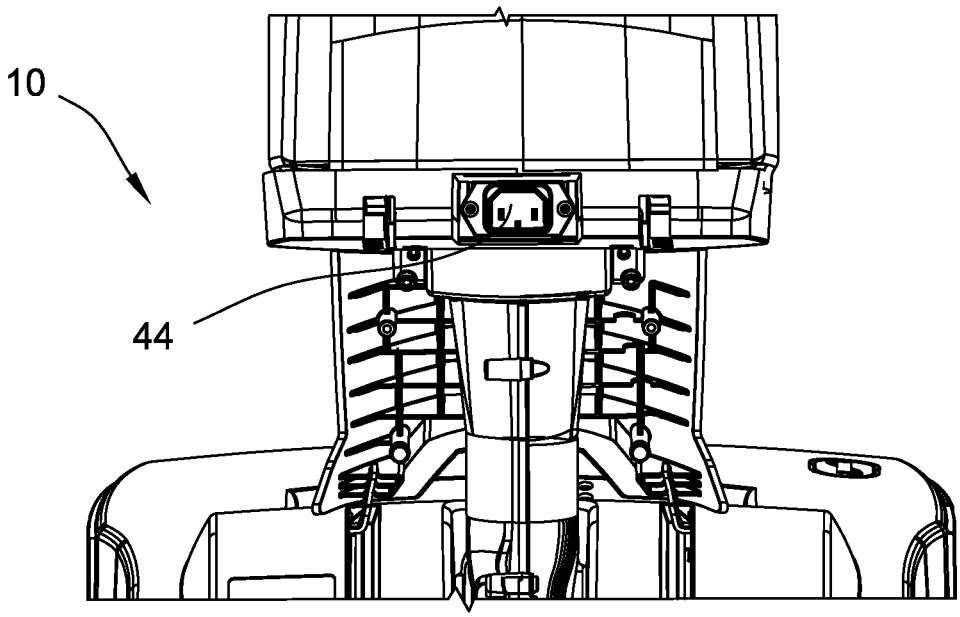
FIG. 6 is a rear view of the upright vacuum cleaner showing an electrical connection interface.
Figure 7:
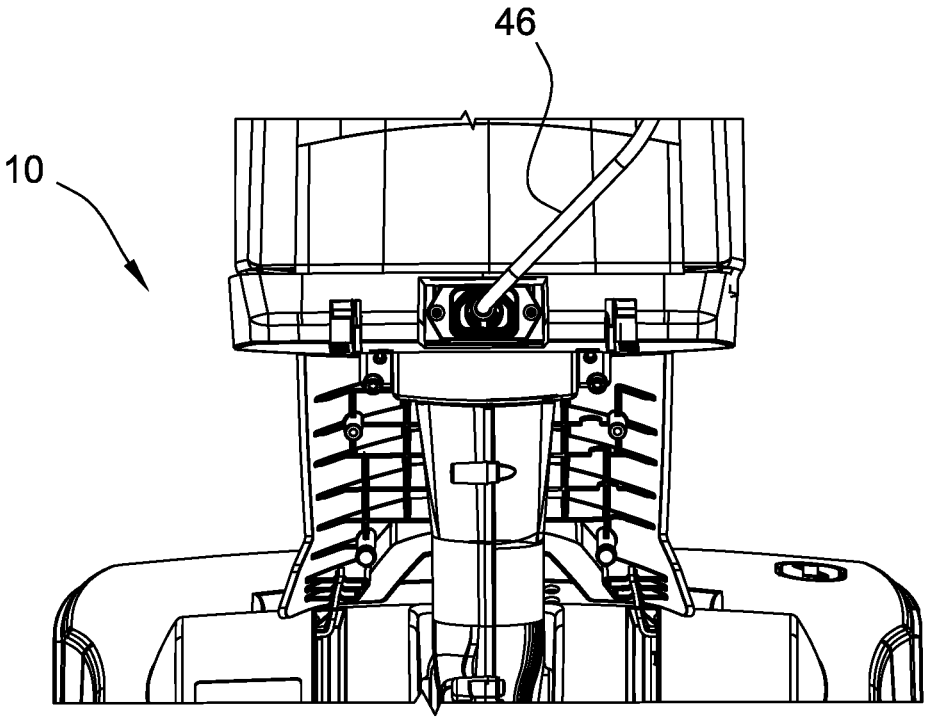
FIG. 7 is a rear view of the vacuum cleaner in a corded mode.

The vacuum cleaning system 10 is configured to selectively operate under direct current (DC) battery power or alternating current (AC) power. In the illustrated embodiment, the vacuum cleaner 12 may be selectively powered by a DC battery in a cordless mode (FIG. 1-5) or by an AC power source (i.e., AC electricity supplied to households and businesses) in a corded mode (FIG. 7). The vacuum cleaner 12 includes an electrical connection interface 44 (shown as a power connector in FIG. 6) that is selectively connectable to the power source. The electrical connection interface 44 may connect to the direct current (DC) battery 57 (FIG. 1) or connect to AC power by use of power cord 46 (FIG. 7). In other embodiments, the vacuum cleaner 12 is powered only by a battery.

The electrical connection interface 44 may be a power connector as shown or may include components internal to the vacuum cleaner such as pins, pads, connectors, wires or the like that may be connected to a control board 99 (FIG. 2), motor assembly 19 and/or other components.

The battery 57 comprises a battery power pack 53 (FIG. 4) having a plurality of rechargeable batteries cells within a casing. The battery cells may include any suitable battery chemistry and design such as lithium ion batteries, lead-acid batteries, nickel-cadmium batteries, nickel-zinc batteries and nickel metal hydride batteries. In some embodiments, the batteries are lithium-ion batteries. The battery 57 is suspended from a battery support plate 61. The battery support plate 61 is attached to the debris tube 31. In some embodiments, when the battery 57 is at least partially charged, the battery 57 is capable of providing 92-volt, DC power to the vacuum cleaner 12 (e.g., 92.4 VDC). Other suitable output voltages of the battery 57 include, for example and without limitation, about 80 VDC and about 108 VDC.

The upright vacuum cleaner 12 includes a filter mount 75 to removably connect the removable filter assembly 35. The filter mount 75 is in fluid communication with the debris tube 31. The filter mount 75 includes a hood 77 (FIG. 8) to direct airflow and debris into the filter assembly 35. The filter mount 75 includes a filter mount body 79 and a filter mount cover plate 81 pivotally connected to the filter mount body 79 about a pivot axis P. The cover plate 81 may be moved between an open position (FIG. 9) and a closed position (FIG. 8) in which the filter mount cover plate 81 is sealed to the filter mount body 79.

The filter mount 75 includes a lock 82 that holds the cover plate 81 in the closed and sealed position. The cover plate 81 may be released by an operator by pressing the two prongs of the lock 82 toward each other.

Figure 10:
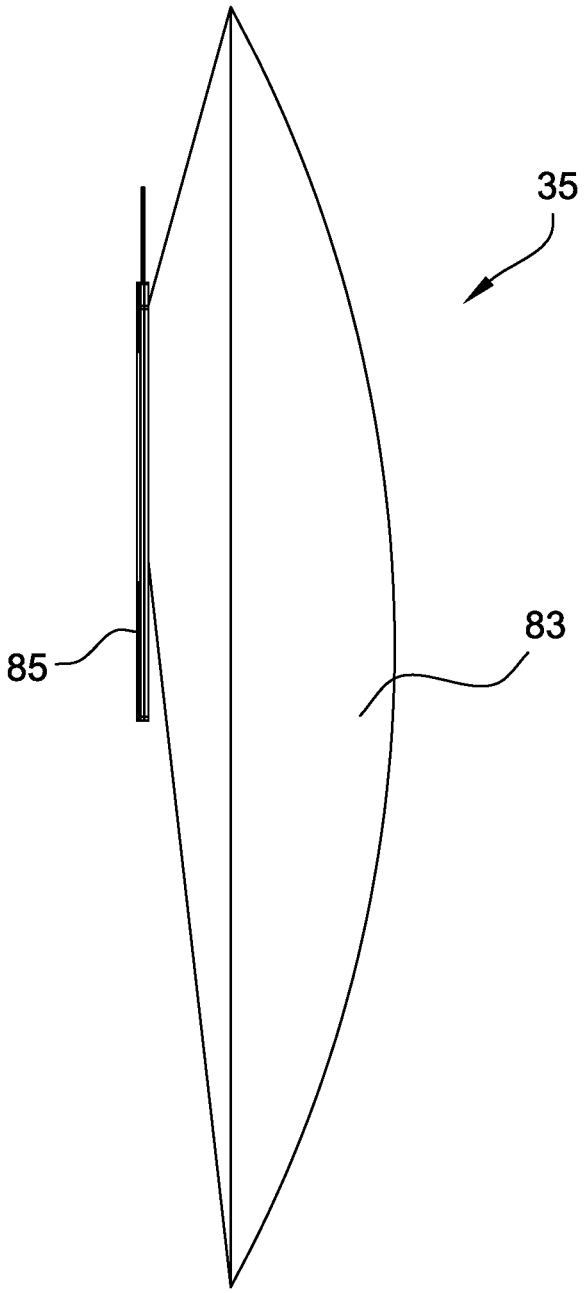
FIG. 10 is a side view of a removable filter assembly of the vacuum cleaner.
Figure 11:
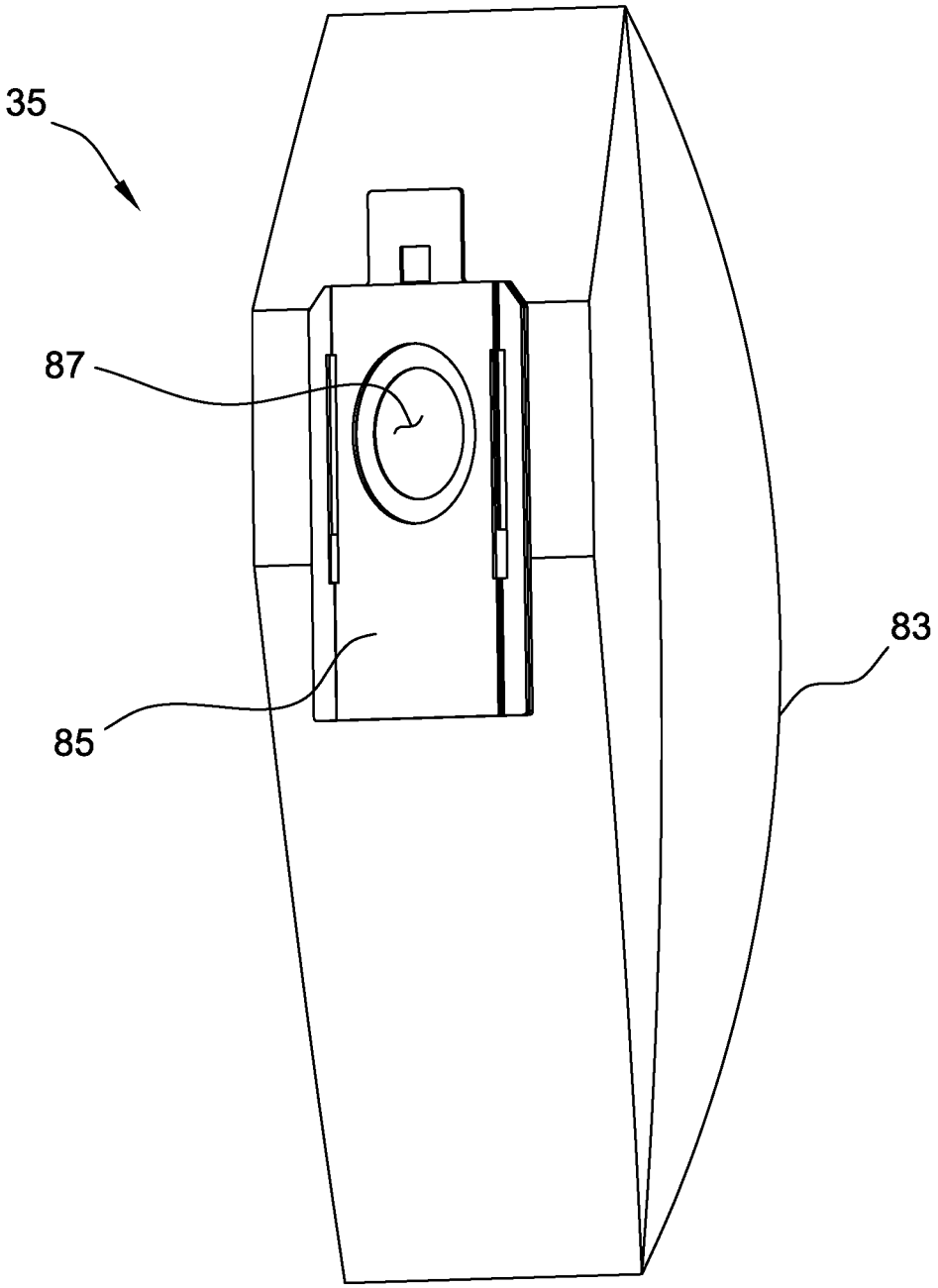
FIG. 11 is a perspective view of the removable filter assembly.

Referring now to FIG. 10, the filter assembly 35 includes a filter body 83 and a flanged connection 85. The flanged connection 85 includes an opening 87 (FIG. 11) through which the air and debris are introduced into the filter assembly 35. The filter body 83 selectively allows air to pass through the filter body 83 while retaining debris in the filter body 83. In some embodiments, the filter body 83 is a micro-filter or even a HEPA filter. Air that passes through the filter body 83 also passes through the filter housing 39 (FIG. 1).

Figure 12:
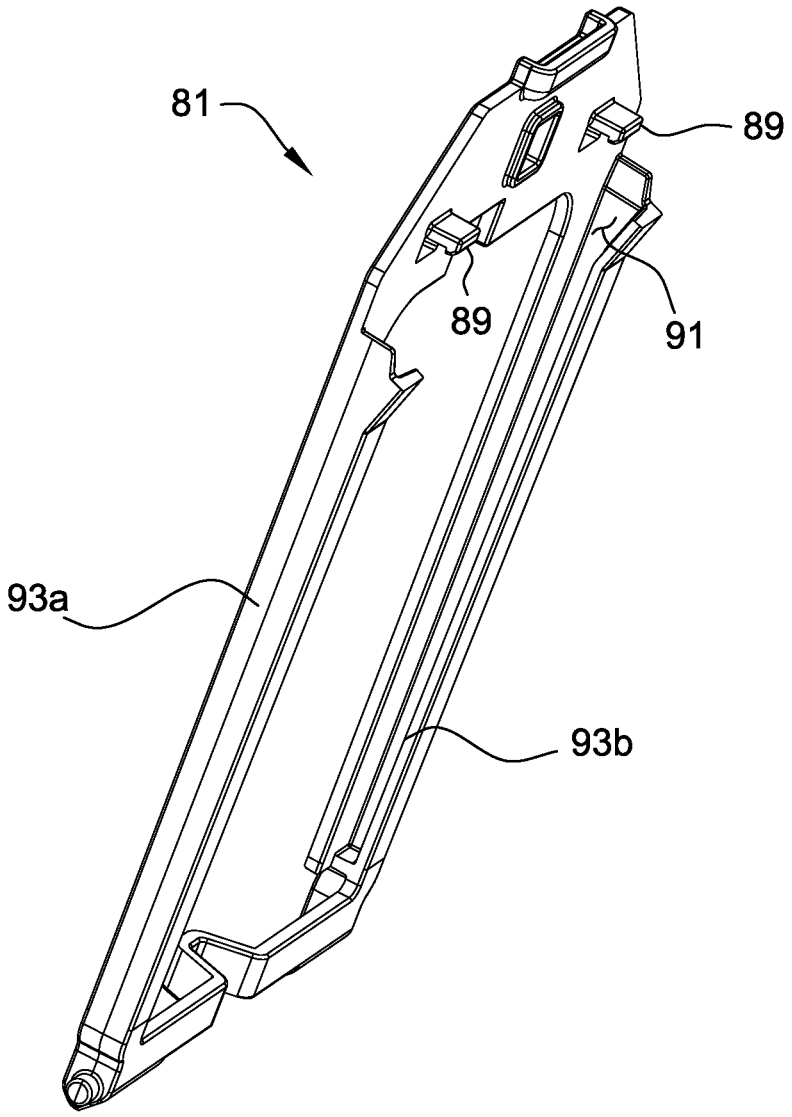
FIG. 12 is a perspective view of a cover plate of the filter mount.

The filter mount cover plate 81 is configured to be attached to the removable filter assembly 35. The filter mount cover plate 81 includes a groove 91 (FIG. 12) that receives the flanged connection 85 (FIG. 10) of the filter assembly 35. In the illustrated embodiment, the cover plate 81 includes two legs 93*a*, 93*b* that each includes a groove 91 for receiving the flanged connection 85. Upon insertion, the flanged connection 85 engages positioning tabs 89 (FIG. 9) on the filter mount cover plate 81.

Figure 8:
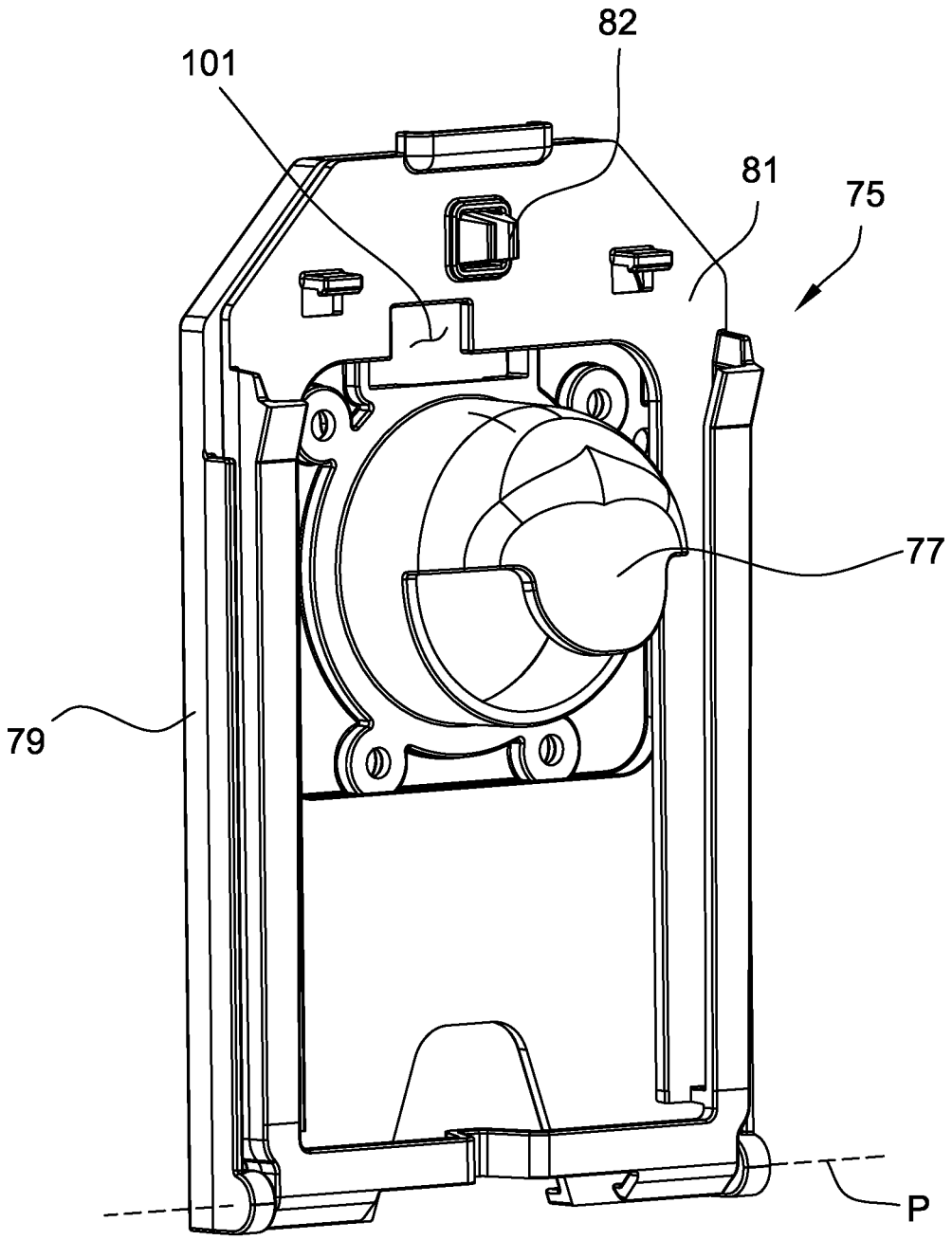
FIG. 8 is a perspective view of a filter mount of the vacuum cleaner in an closed, sealed position.
Figure 9:
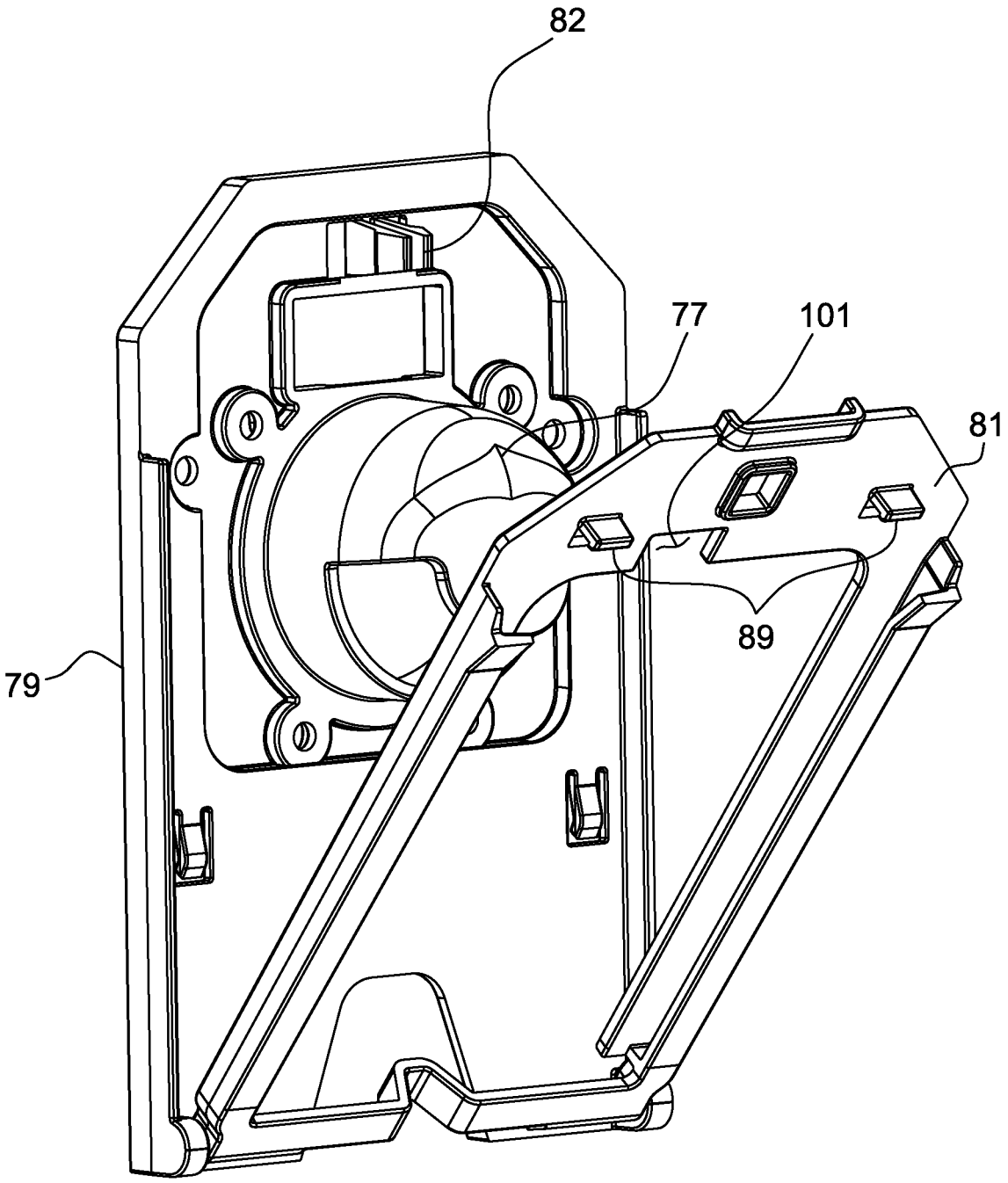
FIG. 9 is a perspective view of the filter mount in an open position.
Figure 13:
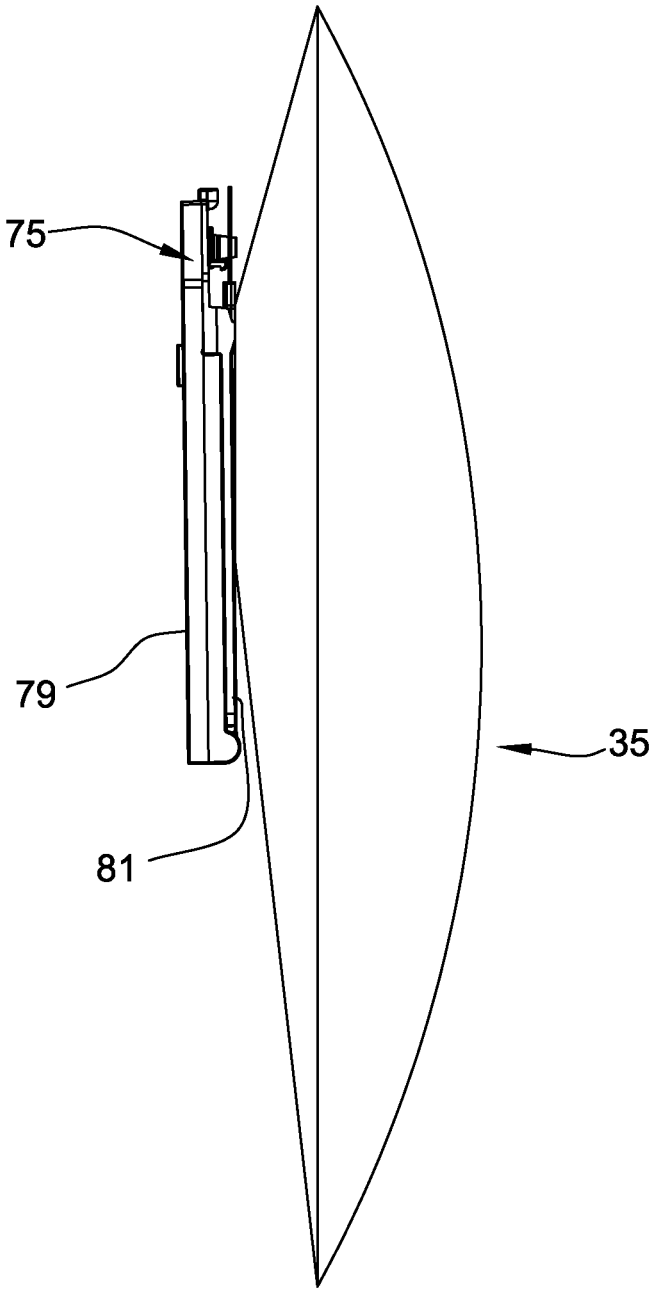
FIG. 13 is a side view of the filter assembly connected to the filter mount.

To insert the removable filter assembly 35 into the upright vacuum cleaner 12, after the access door 49 (FIG. 5) of the filter housing 39 is opened, the lock 82 (FIG. 8) is deactivated (i.e., by pressing the two prongs toward each other) and the cover plate 81 is moved to the open position (FIG. 9). The flanged connection 85 (FIG. 10) of the filter assembly 35 is slid into the groove 91 (FIG. 12) of the filter mount cover plate 81. The cover plate 81, with the attached filter assembly 35, is then moved to the closed position (FIG. 13) and is secured by lock 82 (FIG. 8). To remove the filter assembly 35 (e.g., such as after the filter body 83 is filled with debris), the lock 82 is deactivated and the cover plate 81 is moved to the open position and the filer assembly is pulled from the groove 91 (FIG. 12) of the filter mount cover plate 81.

Figure 14:
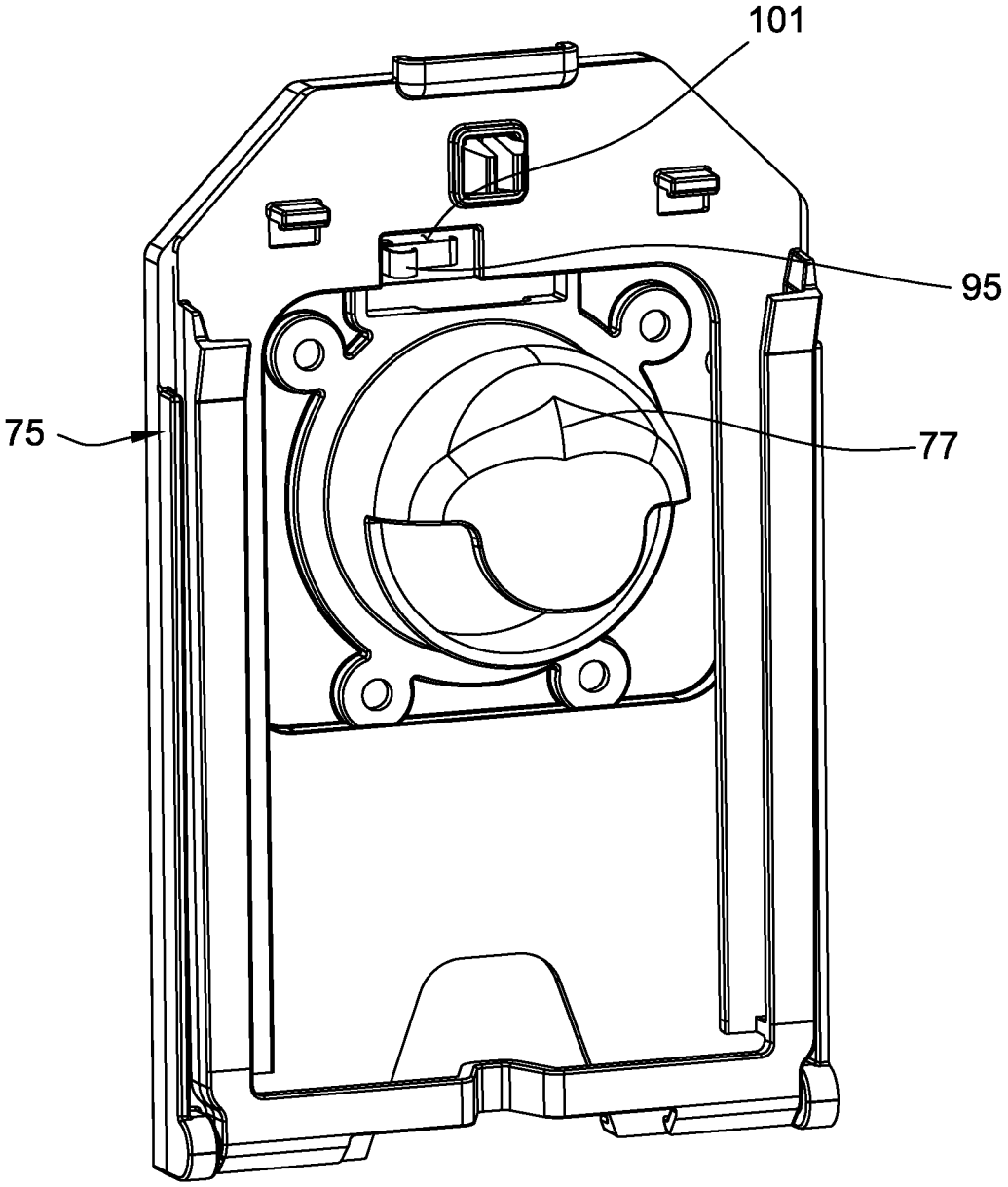
FIG. 14 is a perspective view of the filter mount and a microswitch.

As shown in FIG. 14, the upright vacuum cleaner includes a microswitch 95 disposed on the upright vacuum cleaner 12 to be contacted by the removable filter assembly 35 when the removable filter assembly 35 is connected to the upright vacuum cleaner 12. The microswitch 95 is a normally open switch and detects when the filter assembly 35 (FIG. 13) is connected to the filter mount cover plate 81 with the cover plate 81 being in the closed position. The switch is configured to enable operation of the blower 25 (FIG. 3) in response to being contacted by the removable filter assembly 35. The main body 79 of the filter mount 75 includes an indent 101 through which the microswitch 95 extends. This allows the microswitch 95 to contact and actuate the flanged connection 85 (FIG. 13) of the removable filter assembly 35 when the filter assembly 35 is inserted in the cover plate 81 and the cover plate 81 is in the closed position.

Figure 15:
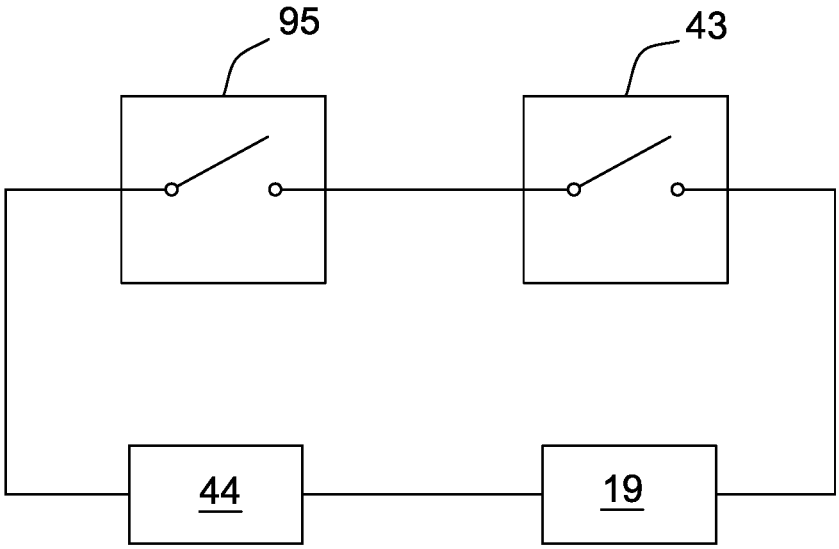
FIG. 15 is a schematic of a vacuum cleaner circuit having a microswitch.

With reference to FIG. 15, the microswitch 95 is operably connected to the motor assembly 19 that powers the blower 25 (FIG. 2) to selectively enable operation of the blower 25 when the removable filter assembly 35 (FIG. 13) is connected to the upright vacuum cleaner 12 in fluid communication with the blower 25. In the illustrated embodiment, the microswitch selectively enables operation of the blower 25 when the removable filter assembly 35 is connected to the filter mount cover plate 81 (FIG. 13) and the filter mount cover plate 81 is in the closed position. As shown in FIG. 15, the electrical connection interface 44 (connected to the power source), blower motor assembly 19, microswitch 95 and power switch 43 form a circuit for operation of the blower. In the circuit, the blower may only be operated when both the microswitch 95 and power switch 43 are actuated.

Figure 16:
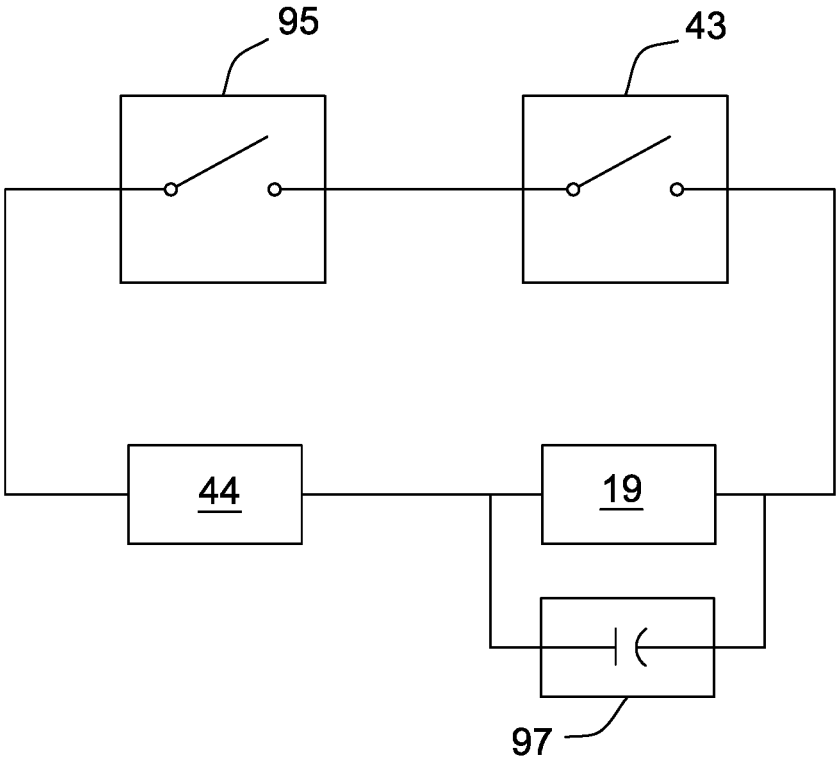
FIG. 16 is a schematic of a vacuum cleaner circuit having a microswitch and capacitor.

In the embodiment illustrated in FIG. 16, the upright vacuum cleaner 12 includes a capacitor 97 that is operatively connected across the motor assembly 19. The capacitor 97 protects the switches from voltage transients which may occur when open circuiting the inductive circuit inherent with motors. The stored energy in the motor collapses when either switch 43, 95 is open in the form of a high voltage pulse. The capacitor 97 acts to snub this transient.

In some embodiments, the capacitor 97 is part of the control board 99. The capacitator 97 may be operatively connected to other components of the upright vacuum cleaner 12 such as the blower motor relay and motor to protect the components from voltage transients. In some embodiments, the capacitor is a film capacitor. The capacitor may have a relatively low inductance and relatively high dv/dt rating. In some embodiments, the capacitance of the capacitor 97 is from about 0.1 μF to about 10 μF, from about 0.1 μF to about 5 μF, or from about 0.5 μF to about 5 μF.

Compared to conventional upright vacuum cleaners, the upright vacuum cleaner of embodiments of the present disclosure has several advantages. By using a two-piece filter mount with a portion that connects to the removable filter assembly and a microswitch that contacts the installed filter assembly when the filter mount is moved to a closed position, the vacuum cleaner blower may be prevented from operating when the filter assembly is not installed in the vacuum cleaner. This prevents the vacuum cleaner from operating without a filter assembly and from filling the filter housing with debris. This is particularly advantageous in upright vacuum cleaners in which the filter assembly is not visible to the operator after installation.

In embodiments in which the upright vacuum includes a capacitor, the capacitor protects the microswitch from voltage transients from the motor. This may be particularly advantageous in embodiments in which the upright vacuum cleaner is powered by a battery which is susceptible to fluctuations in voltage. The capacitor and microswitch may have relatively long life cycles.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. An upright vacuum cleaner comprising:

a blower for entraining debris into an airstream and into a removable filter assembly;

a filter housing having an access door to allow the removable filter assembly to be attached and removed from the vacuum cleaner;

a filter mount for connecting the removable filter assembly, the filter mount comprising:

a body;

a filter mount cover plate, the filter mount cover plate being adjustable between an open position and a closed position in which the filter mount cover plate is sealed to the body, the filter mount cover plate attachable to the removable filter assembly; and a microswitch connected to the blower to selectively enable operation of the blower when the filter assembly is connected to the filter mount cover plate and the filter mount cover plate is in the closed position.

2. The upright vacuum cleaner of claim 1 wherein the filter mount cover plate is pivotally connected to the filter mount body.

3. The upright vacuum cleaner of claim 1 including the removable filter assembly to filter and collect debris from an airstream.

4. The upright vacuum cleaner of claim 3 wherein the removable filter assembly is attached to the filter mount cover plate.

5. The upright vacuum cleaner of claim 1 wherein the filter mount cover plate includes a slot for receiving a flanged connection of the removable filter assembly.

6. The upright vacuum cleaner of claim 5 wherein the microswitch is disposed on the upright vacuum cleaner to be contacted by the flanged connection of the removable filter assembly when the filter mount cover plate is in the closed position, the microswitch being adapted to enable operation of the blower in response to being contacted by the flanged connection of the removable filter assembly.

7. The upright vacuum cleaner of claim 1 further comprising a cleaning head for removing debris from a floor and into the vacuum cleaner.

8. The upright vacuum cleaner of claim 1 further comprising a motor assembly for powering the blower, the microswitch being connected to the motor assembly to selectively enable operation of the blower when the filter assembly is attached to the filter mount cover plate and the filter mount cover plate is in the closed position, and wherein the upright vacuum cleaner is adapted to selectively operate using direct current (DC) power or AC power.

9. The upright vacuum cleaner of claim 1 wherein the filter housing is made of a flexible fabric.

10. A vacuum cleaner comprising:

a removable filter assembly;

a filter housing having an access door to allow the removable filter assembly to be attached and removed from the vacuum cleaner;

a blower for entraining debris into an airstream and into the removable filter assembly;

a motor assembly for powering the blower;

a filter mount for connecting the removable filter assembly, the filter mount comprising:

a body;

a filter mount cover plate, the filter mount cover plate being adjustable between an open position and a closed position; and a microswitch connected to the blower to selectively enable operation of the blower when the filter assembly is connected to the filter mount cover plate and the filter mount cover plate is in the closed position.

11. The vacuum cleaner of claim 10 wherein the filter mount cover plate is sealed to the filter mount body when in the closed position.

12. The vacuum cleaner of claim 10 wherein the removable filter assembly is attached to the filter mount cover plate.

13. The vacuum cleaner of claim 12 wherein the filter mount cover plate includes a slot for receiving a flanged connection of the removable filter assembly.

14. The vacuum cleaner of claim 13 wherein the microswitch is disposed on the vacuum cleaner to be contacted by the flanged connection of the removable filter assembly when the filter mount cover plate is in the closed position.

15. The vacuum cleaner of claim 10 further comprising a cleaning head for removing debris from a floor and into the vacuum cleaner.

16. The vacuum cleaner of claim 15 wherein the microswitch is connected to the motor assembly to selectively enable operation of the blower when the filter assembly is attached to the filter mount cover plate and the filter mount cover plate is in the closed position, and wherein the upright vacuum cleaner is adapted to selectively operate using direct current (DC) power or AC power.

17. The vacuum cleaner of claim 10 wherein the microswitch is connected to the motor assembly to selectively enable operation of the blower when the filter assembly is attached to the filter mount cover plate and the filter mount cover plate is in the closed position, and wherein the upright vacuum cleaner is adapted to selectively operate using direct current (DC) power or AC power.

* * * * *